United States Patent [19]

Gipson

[11] 4,331,297

[45] May 25, 1982

[54] WATER SPRAY ATTACHMENT FOR CONCRETE FINISHING MACHINE

[76] Inventor: Wyllie T. Gipson, 1917 N. Minnesota, Wichita, Kans. 67214

[21] Appl. No.: 167,248

[22] Filed: Jul. 10, 1980

[51] Int. Cl.[3] ..... B05B 9/043

[52] U.S. Cl. ..... 239/289; 239/373; 404/112

[58] Field of Search ..... 239/146, 154, 172, 175, 239/195, 289, 337, 373, 444, 578, DIG. 6; 15/50 R; 51/174, 177; 404/108, 110–112, 128, 129

[56] References Cited

U.S. PATENT DOCUMENTS

| | | | |
|---|---|---|---|
| 2,109,933 | 3/1938 | Sloan | 404/112 |
| 2,181,375 | 11/1939 | Leistner et al. | 404/112 |
| 2,772,921 | 12/1956 | Nance | 239/373 X |
| 2,804,259 | 8/1957 | Ralston | 239/373 X |
| 3,023,969 | 3/1962 | Hudson et al. | 239/146 |
| 3,361,044 | 1/1968 | Wolf et al. | 404/112 |

*Primary Examiner*—Johnny D. Cherry

[57] ABSTRACT

An improved water spray apparatus for attachment to a concrete finishing machine. The improved water spray apparatus applies water by misting or spraying water on top of freshly poured concrete as the concrete surface is finished by rotating concrete blades of the concrete finishing machine. The apparatus eliminates the need of applying water separately by water bucket or water hose during the concrete finishing operation.

1 Claim, 4 Drawing Figures

WATER SPRAY ATTACHMENT FOR CONCRETE FINISHING MACHINE

BACKGROUND OF THE INVENTION

This invention relates to an improved water spray apparatus used in finishing concrete and the like, and more particularly, but not by way of limitation, to a water spray apparatus attached to the top of a hand-operated concrete finishing machine having rotating blades used for finishing concrete floors.

Heretofore, in the concrete finishing business, hand-operated gasoline driven concrete finishing equipment has been used without any means for applying water to the concrete surface as the finishing blades are rotated on top of the floor. This problem has been solved by the use of a water bucket or a water hose and used as the need arises. Using the water bucket or the separate hose increases the time and labor required in finishing concrete and often sufficient water is not applied in time to obtain a smooth concrete surface prior to the concrete setting up. The subject invention eliminates the above-described problems and is described herein.

In U.S. Pat. No. 3,361,044 to Wolf, et al, U.S. Pat. No. 2,109,933 to Sloan, U.S. Pat. No. 2,078,289 to Sloan, U.S. Pat. No. 2,836,056 to Drummond, and U.S. Pat. No. 2,860,506 to Drummond, various types of plastering trowels and concrete finishing equipment are described and having means for introducing water as the concrete and the plaster is finished. None of these prior art devices disclose the unique structure and improvements as described herein for mounting to existing concrete finishing equipment.

SUMMARY OF THE INVENTION

The improved water spray apparatus is easily adapted for attachment to existing hand-operated gasoline powered concrete finishing equipment. The apparatus is simple in design, rugged in construction and eliminates the need for using a water bucket or a separate water hose for applying water during the concrete finishing operation.

The water spray apparatus applies a fine spray or mist of water directly on top of the finishing blades and concrete.

The improved water spray apparatus greatly reduces wear on the blades of the finishing equipment and decreases the horsepower required in driving the finishing blades. Also, the invention reduces the time required to complete the finishing operation of a concrete surface and in turn reduces the cost of labor.

Further, the apparatus by providing a continuous supply of water when required in finishing the concrete allows the finishing equipment to provide a better overall finish to the concrete surface.

The improved water spray apparatus for attachment to a concrete finishing machine includes a water tank adapted for attachment to the finishing machine with a hand-operated water pump releasably attached to the top of the tank for pressurizing the water in the tank. A water tank spray nozzle is attached to the bottom of the tank for spraying or misting water onto the freshly poured concrete as the blades rotate on top of the concrete and below the water tank spray nozzle. A water valve is attached to the spray nozzle for turning the water on and off to the nozzle. A water hose having one end attached to the water tank with the other end attached to a water hose spray nozzle is used for spraying water adjacent the concrete finishing machine during the operation of finishing the concrete.

The advantages and objects of the invention will become evident from the following detailed description of the drawings when read in connection with the accompanying drawings which illustrate preferred embodiments of the invention.

DETAILED DESCRIPTION OF THE DRAWINGS

Figure 1:
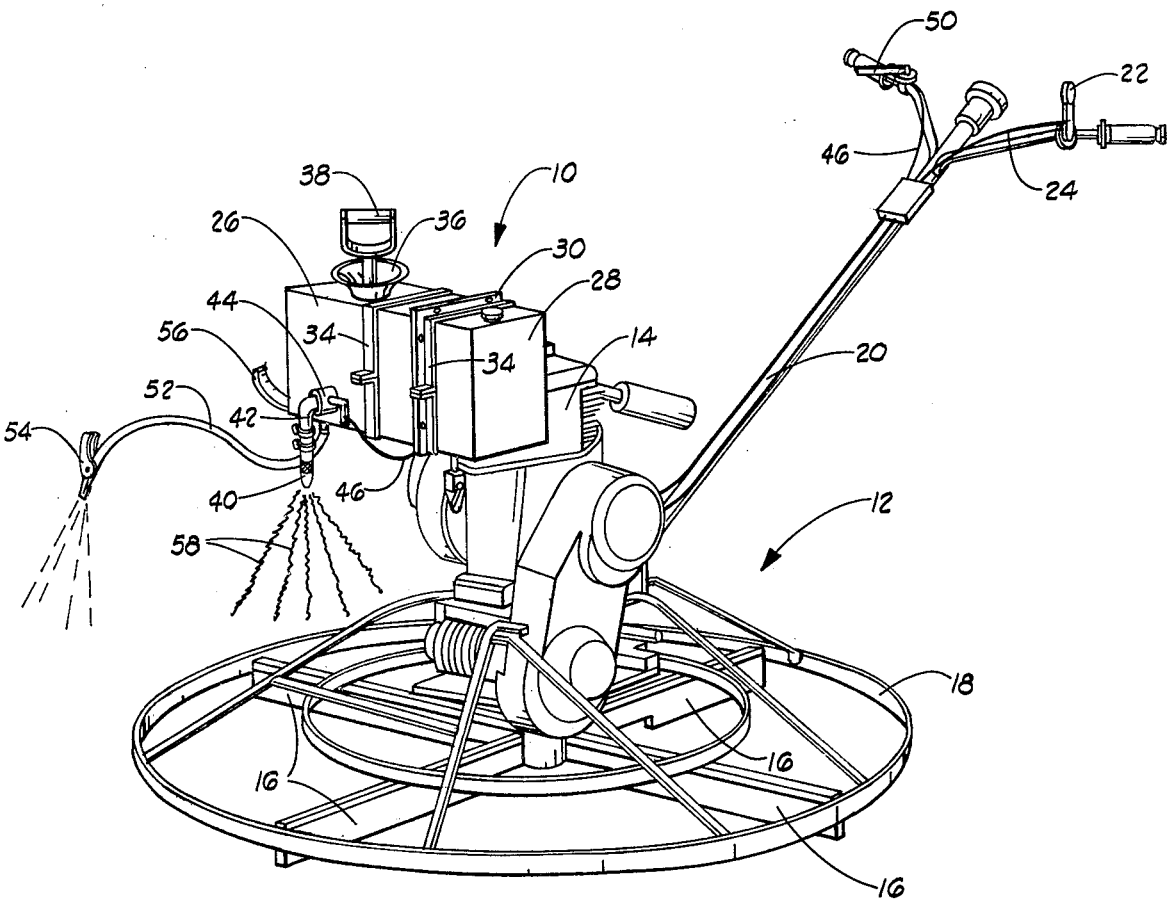
FIG. 1 is a perspective view of the improved water spray apparatus attached to a gasoline driven concrete finishing machine.

In FIG. 1 the improved water spray apparatus is designated by general reference numeral 10. The apparatus 10 is mounted on top of a concrete finishing machine designated by general reference numeral 12. The machine 12 includes a gasoline driven engine 14 which drives a plurality of rotating concrete finishing blades 16 which are surrounded by a circular guard ring 18. The machine 12 is hand-operated by gripping a handle 20. The speed of the engine 14 is controlled by a throttle 22 attached to one end of the handle 20 and connected to the engine 14 by a cable 24.

The improved water spray apparatus 10 includes a water tank 26 which may be secured to the existing gasoline fuel tank of the machine 12 or may include its own fuel tank 28 which is secured to one end of the water tank 26 by a bolted flange 30. The water tank 26 and fuel tank 28 are secured to the gasoline engine 14 by a pair of attachment bands 34. The water tank 26 includes a fill spout 36 in the top thereof which releasably engages a water pump 38 which can be removed when filling the tank 26 with water. When the pump 38 is inserted into the fill spout 36, the pump 38 is hand-operated for pressurizing the water therein. The top of the pump 38 also acts as a cap for the fill spout 36.

Attached to the bottom of the water tank 26 is a water tank spray nozzle 40 which is communicably connected to the tank 26 by a water line 42 having a valve 44 mounted therein. The valve 44 may be opened and closed by a cable 46. The cable 46 is mounted along the handle 20 and is connected to a water spray lever 50 attached to the end of the handle 20. By rotating the water spray lever 50, the valve 44 can be opened for applying water to the concrete surface.

An additional feature of the apparatus 10 is a water hose 52 having one end attached to the bottom of the water tank 26 with the other end attached to a water hose spray nozzle 54. When the hose 52 is not in use, it is coiled around a semi-circular hose carrier 56 attached to the side of the water tank 26. The water hose 52 allows the operator of the machine 12 to provide water to areas adjacent the machine 12 during the finishing operation.

Figure 2:
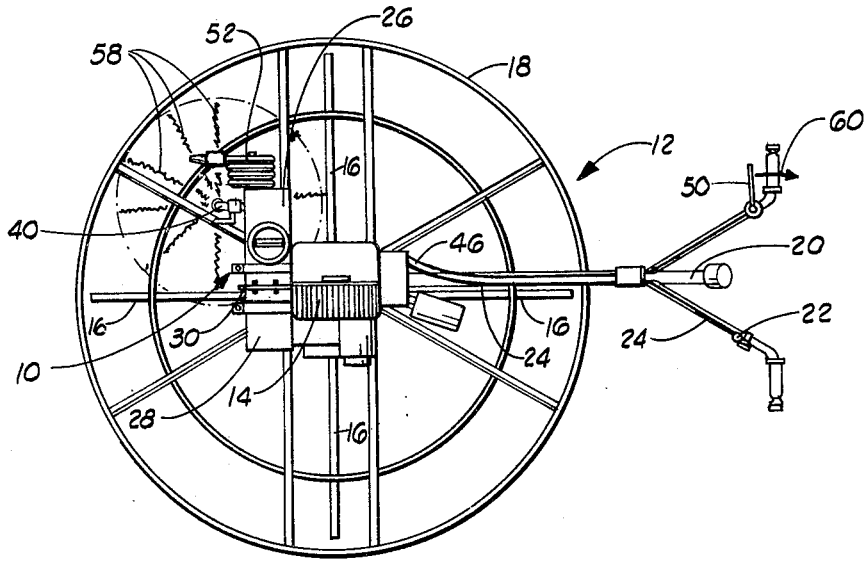
FIG. 2 is a top view of the concrete finishing machine with the improved water spray apparatus attached thereto.

In FIG. 2 a top view of the improved water spray apparatus 10 and concrete finishing machine 12 can be seen. In this view, a spray 58 or misting of the water can be seen applied to the top of the concrete surface in a circular pattern which extends outwardly to the periphery of the area finished by the rotating finishing blades 16. In this fashion, the water is applied uniformly to a circular area being finished by the concrete finishing machine 12. As the finishing blades 16 rotate underneath the water spray nozzle 40, water is applied not only to the top of the concrete, but to the top of the blades 16, thereby providing sufficient water for finishing the concrete and reducing wear and friction on the leading edge and on the bottom of the blades 16 as they rotate on top of the concrete surface. This feature reduces maintenance on the machine 12, wear on the blades 16, and the horsepower requirement in driving the blades 16. Also, because of these features, the time required in finishing the concrete is greatly reduced.

In this view, the water hose 52 can be seen wrapped around the hose carrier 56 when the hose 52 is not required. Also in this view the water spray lever 50 can be seen in an "on" position. By rotating the lever 50 in a clockwise direction indicated by arrow 60, the water spray valve 44 may be turned off, thereby shutting off the supply of water to the spray nozzle 40.

Figure 3:
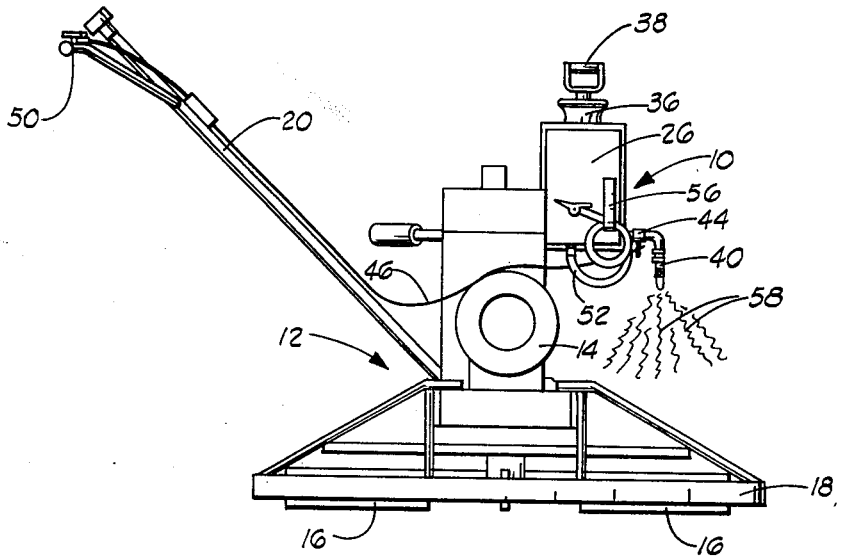
FIG. 3 is a side view of the concrete finishing machine and improved water spray apparatus.

In FIG. 3 a side view of the machine 12 and improved water spray apparatus 10 can be seen. In this view, the water hose 52 is again cooled around the hose carrier 56 when it is not in use. Also, in this view the blades 16 can be seen riding on top of the concrete surface with the water spray 58 or mist being applied directly above the blades 16 as they rotate underneath the water spray nozzle 40.

Figure 4:
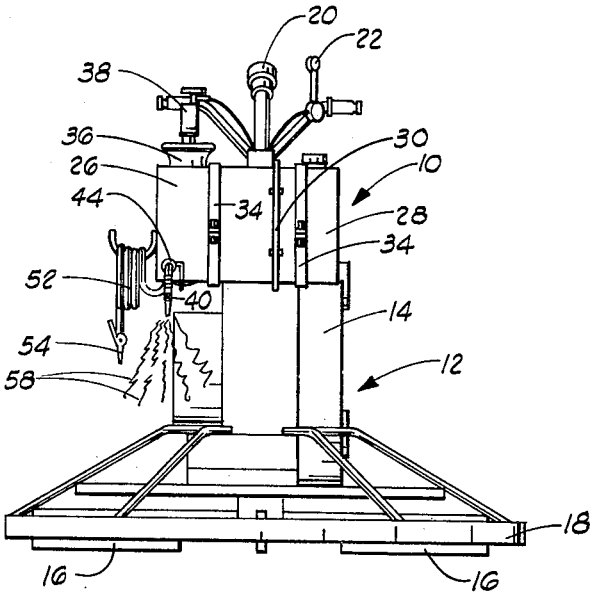
FIG. 4 is a front view of the improved water spray apparatus attached to the concrete finishing machine.

In FIG. 4 a front view of the improved water spray apparatus 10 can be seen mounted on top of the gasoline engine 14 of the machine 12. In this view the water tank 26 can be seen mounted end-to-end with the gasoline fuel tank 28 and secured together by the bolted flange 30.

From reviewing the above-described figures, it can be seen that the improved water spray apparatus 10 is self-contained and can be quickly mounted on different types and sizes of concrete finishing equipment to improve the overall concrete finishing operation. Further, the apparatus 10 applies water by spraying or misting directly on top of the concrete, or water can be applied to an area adjacent the machine 12 by using the water hose 52. Also, the volume of water and gasoline storage can be increased by simply increasing the size of the tanks 26 and 28.

Changes may be made in construction and arrangement of the parts or elements of the embodiments as disclosed herein without departing from the spirit or scope of the invention as defined in the following claims.

I claim:

1. An improved water spray apparatus for attachment to a concrete finishing machine having rotating finishing blades, the apparatus comprising:

a water tank adapted for attachment to the top of the finishing machine;

a fuel tank releasably attached to one side of the water tank;

a hand operated water pump relesably attached to the top of the water tank for pressurizing the water in the tank, the hand operated water pump acts as a cap on top of the water tank, by removing the pump the opening in the top of the water tank is used for filling the tank with water;

a water tank spray nozzle attached to the bottom of the water tank for spraying water in a circular pattern adjacent the inside of the finishing blades outwardly to the outside of the finishing blades and the periphery of the area finished by the rotating finishing blades, the water applied to the top of the blades, the leading edge of the blades and onto the freshly poured concrete as the concrete is finished by the finishing machine;

a water valve communicably connected between the water tank and the water tank spray nozzle;

a cable having one end attached to the water valve;

a water spray lever attached to the other end of the cable and adapted for attachment to the concrete finishing machine, by rotating the water spray lever, the water valve is opened and closed;

a water hose having one end attached to the water tank, the other end attached to a water hose spray nozzle for spraying concrete adjacent the concrete finishing machine; and a water hose carrier attached to the side of the water tank so the water hose may be coiled therearound when the water hose is not required.

* * * * *